US006068138A

United States Patent [19]

Carlson et al.

[11] Patent Number: 6,068,138

[45] Date of Patent: May 30, 2000

[54] DISPENSER FOR A STACK OF SHEETS

[75] Inventors: Casey L. Carlson, Edina; Daniel E. Siltberg, White Bear Lake; James J. Trussell; David C. Windorski, both of Woodbury, all of Minn.

[73] Assignee: 3M Innovative Properties Company, St. Paul, Minn.

[21] Appl. No.: 09/144,946

[22] Filed: Sep. 1, 1998

[51] Int. Cl.[7] ..... A47F 7/00

[52] U.S. Cl. ..... 211/50

[58] Field of Search ..... 211/50, 49.1, 10, 211/11, 58, 126.1, 126.16; 206/215

[56] References Cited

U.S. PATENT DOCUMENTS

| | | | |
|---|---|---|---|
| D. 270,739 | 9/1983 | Pearson | D19/78 |
| D. 270,740 | 9/1983 | Pearson | D19/78 |
| D. 271,981 | 12/1983 | Pearson | D19/86 |
| D. 273,798 | 5/1984 | Pearson | D19/91 |
| D. 287,862 | 1/1987 | Hauser et al. | D19/78 |
| D. 305,246 | 12/1989 | Kirchhoff et al. | D19/75 |
| D. 310,688 | 9/1990 | Windorski | D19/86 |
| D. 316,112 | 4/1991 | Windorski | D19/86 |
| D. 322,632 | 12/1991 | Montgomery et al. | D19/86 |
| D. 322,990 | 1/1992 | Samuelson | D19/78 |
| D. 329,872 | 9/1992 | Carlson et al. | D19/26 |
| D. 330,219 | 10/1992 | Carlson et al. | D19/77 |
| D. 331,073 | 11/1992 | Dotterman et al. | D19/86 |
| D. 331,074 | 11/1992 | Dotterman et al. | D19/86 |
| D. 331,075 | 11/1992 | Dotterman et al. | D19/86 |
| D. 334,212 | 3/1993 | Dotterman et al. | D19/86 |
| D. 342,758 | 12/1993 | Kirchhoff et al. | D19/75 |
| D. 342,759 | 12/1993 | Kirchhoff et al. | D19/86 |
| D. 358,425 | 5/1995 | Kirchhoff et al. | D19/86 |
| D. 358,846 | 5/1995 | Kirchhoff et al. | D19/78 |
| D. 359,513 | 6/1995 | Carlson | D19/86 |
| D. 362,462 | 9/1995 | Carlson et al. | D19/66 |
| D. 362,687 | 9/1995 | Kirchhoff et al. | D19/92 |
| D. 372,499 | 8/1996 | Carlson et al. | D19/65 |
| D. 372,938 | 8/1996 | Wilson et al. | D19/75 |
| D. 387,806 | 12/1997 | Carlson et al. | D19/86 |
| D. 387,808 | 12/1997 | Carlson | D19/99 |
| D. 396,247 | 7/1998 | Carlson et al. | D19/86 |
| D. 396,249 | 7/1998 | Carlson | D19/99 |
| D. 396,492 | 7/1998 | Carlson et al. | D19/86 |
| D. 405,471 | 2/1999 | Carlson | D19/99 |
| 1,170,541 | 2/1916 | Jacobus | 211/50 |
| 1,533,880 | 4/1925 | Malwitz | 211/50 |
| 2,100,720 | 11/1937 | Page | 211/50 |
| 4,416,392 | 11/1983 | Smith | 221/45 |
| 4,562,938 | 1/1986 | Loder | 221/46 |
| 4,568,629 | 2/1986 | Loder | 221/46 |
| 4,568,630 | 2/1986 | Loder | 221/46 |
| 4,586,631 | 5/1986 | Loder | 221/58 |
| 4,653,666 | 3/1987 | Mertens | 221/45 |
| 4,667,828 | 5/1987 | Samuelson | 206/555 |
| 4,696,399 | 9/1987 | Windorski | 211/50 |
| 4,781,306 | 11/1988 | Smith | 221/33 |
| 4,796,781 | 1/1989 | Windorski | 221/45 |

(List continued on next page.)

FOREIGN PATENT DOCUMENTS

| | | |
|---|---|---|
| 2 465 589 | 3/1981 | France . |
| 2063531 | 5/1997 | United Kingdom . |
| 97/48561 | 12/1997 | WIPO . |

OTHER PUBLICATIONS

Copy of International Search Report for PCT/US99/05822, dated Jun. 25, 1999.

*Primary Examiner*—Alvin Chin-Shue
*Assistant Examiner*—Sarah Purol

[57] ABSTRACT

A dispenser for a stack of sheets. A preferred embodiment of the invention provides a dispenser for a stack of sheets comprising a tray including a support surface and a plurality of corner members attached to the tray, where each of the corner members include a first wall and a second wall extending above the support surface, where the second wall is non-parallel to the first wall, and where the support surface is exposed between two adjacent of the plurality of corner members.

45 Claims, 8 Drawing Sheets

U.S. PATENT DOCUMENTS

| | | | |
|---|---|---|---|
| 4,848,584 | 7/1989 | Windorski | 206/565 |
| 4,919,276 | 4/1990 | Kim et al. | 211/50 |
| 4,921,127 | 5/1990 | Windorski | 221/45 |
| 4,957,233 | 9/1990 | Samuelson | 225/26 |
| 4,986,440 | 1/1991 | Windorski | 221/45 |
| 4,993,590 | 2/1991 | Windorski | 221/46 |
| 5,080,255 | 1/1992 | Windorski | 221/45 |
| 5,086,946 | 2/1992 | Blackwell et al. | 221/45 |
| 5,158,205 | 10/1992 | Bodziak et al. | 221/51 |
| 5,165,570 | 11/1992 | Windorski et al. | 221/46 |
| 5,167,346 | 12/1992 | Bodziak | 221/63 |
| 5,299,712 | 4/1994 | Carlson et al. | 221/45 |
| 5,358,141 | 10/1994 | Carlson et al. | 221/185 |
| 5,385,230 | 1/1995 | Nygard et al. | 206/214 |
| 5,390,819 | 2/1995 | Kaye | 221/45 |
| 5,417,345 | 5/1995 | Smith | 221/33 |
| 5,518,144 | 5/1996 | Samuelson et al. | 221/33 |
| 5,526,955 | 6/1996 | Windorski et al. | 221/34 |
| 5,671,557 | 9/1997 | Carlson et al. | 40/358 |
| 5,671,866 | 9/1997 | Bodziak | 221/45 |
| 5,794,815 | 8/1998 | Carlson et al. | 221/45 |

DISPENSER FOR A STACK OF SHEETS

TECHNICAL FIELD

The present invention relates generally to a dispenser for a stack of sheets, and more particularly to a modular dispenser system made from a variety of components, which may be interchanged to form a variety of dispensers.

BACKGROUND OF THE INVENTION

It has long been known to use a dispenser for dispensing a stack of sheets of note paper. The dispensers are available in a variety of sizes to support and dispense a variety of sheets of different dimensions and different shapes. Typically, dispensers include walls to protect all or portions of the edges of the sheets in the stack, while allowing access to the corners of the stack of sheets. Additionally, dispensers usually display stack of sheets horizontally or at a very shallow angle relative to a surface. Lastly, dispensers are typically sold commercially in one configuration that can not be easily changed to display the sheets differently, for instance, to make the sheets more prominent and visible.

It is therefore seen that there exists a need for a dispenser which protects the corners of the stack of sheets from inadvertent contact, while still allowing access to the edges of the sheets between the corners. Additionally, there exists a need for a modular dispenser system made from a variety of components, which may be interchanged to form a variety of dispensers, thus displaying the sheets in a variety of ways.

SUMMARY OF THE INVENTION

One aspect of the present invention provides a dispenser for a stack of sheets. The dispenser comprises a tray including a support surface and a plurality of corner members attached to the tray. Each of the corner members includes a first wall and a second wall extending above the support surface. The second wall is non-parallel to the first wall. The support surface is exposed between two adjacent of the plurality of corner members.

In one preferred embodiment of the above dispenser, the support surface is exposed between each of the plurality of corner members.

In another preferred embodiment of the above dispenser, the dispenser further comprises a center feed cover releasably attached to the plurality of corner members, where the center feed cover includes a sheet dispensing opening. In one aspect of this embodiment, the sheet dispensing opening is centered relative to the tray support surface.

In another preferred embodiment of the above dispenser, the center feed cover comprises a first bridging arm and a second bridging arm. The first arm is releasably attached to a first and a second of the plurality of the corner members, the second arm is releasably attached to a third and a fourth of the plurality of corner members, and the sheet dispensing opening is between the first and second arms.

In another preferred embodiment of the above dispenser, the first arm further comprises a planar sheet mounting surface extending therefrom. In one aspect of this embodiment, the dispenser further comprises a socket including a concave surface. The socket includes the sheet mounting surface, the first arm further includes a convex surface, and the concave surface of the socket is releasably attached to the convex surface of the first arm.

In another preferred embodiment of the above dispenser, the first arm further comprises a sheet mounting wire extending therefrom. In one aspect of this embodiment, the dispenser further comprises a socket including a concave surface, the socket includes the sheet mounting wire, the first arm further includes a convex surface, and the concave surface of the socket is releasably attached to the convex surface of the first arm.

In another preferred embodiment of the above dispenser, the first arm further comprises a receptacle for receiving a first end of a writing implement. In one aspect of this embodiment, the dispenser further comprises a socket including a concave surface, the socket includes the receptacle, the first arm further includes a convex surface, and the concave surface of the socket is releasably attached to the convex surface of the first arm.

In another preferred embodiment of the above dispenser, the first, second, third and fourth corner members each include a respective convex surface. The first arm comprises a first concave surface and a second concave surface. The first concave surface of the first arm is releasably attached to the convex surface of the first corner member, and the second concave surface of the first arm is releasably attached to the convex surface of the second corner member. The second arm comprises a third concave surface and a fourth concave surface. The third concave surface of the second arm is releasably attached to the convex surface of the third corner member and the fourth concave surface of the second arm is releasably attached to the convex surface of the fourth corner member.

In another preferred embodiment of the above dispenser, the first arm further includes a first sheet retaining member moveable from a first position proximate the tray support surface to a second position remote from the support surface. The retaining member is biased towards the first position. In another aspect of this embodiment, the second arm includes a second retaining member moveable from a first position proximate the tray support surface to a second position remote from the support surface. The retaining member is biased toward the first position.

In another preferred embodiment of the above dispenser, each of the first and second walls of the corner members extend from the tray support surface, the first and second walls are generally perpendicular to each other, and each of the corner members includes a convex surface extending between each respective first and second walls opposite the support surface.

In another preferred embodiment of the above dispenser, the tray includes a back surface opposite the support surface. The dispenser further includes a support arm including a first end and a second end opposite the first end, and in which the first end is attached to the back surface. In one aspect of this embodiment, the first end of the support arm is releasably attached to the back surface. In another aspect of this embodiment, the back surface includes first and second arm receiving members, and the first end of the support arm can be releasably attached to either of the first and second arm receiving members. In yet another aspect of this embodiment, the first receiving member is centered on the back surface and the second arm receiving member is remote from the center of the back surface. In another aspect of this embodiment, the second end of the support arm comprises one element of a ball and socket joint.

In another preferred embodiment of the above dispenser, the tray has a first density and the dispenser further includes a base having a second density higher than the first density.

In another preferred embodiment of the above dispenser, the dispenser further comprises a planar back surface opposite the tray support surface. In one aspect of this embodiment, the back surface is non-parallel to the tray support surface. In yet another aspect of this embodiment, the dispenser further comprises a base releasably attached to the tray, in which the base comprises the planar back surface.

In another preferred embodiment of the above dispenser, the dispenser further comprises a convex back surface opposite the support surface. In one aspect of this embodiment, the dispenser further comprises a base releasably attached to the tray, in which the base comprises the convex surface.

In another preferred embodiment of the above dispenser, the dispenser further comprises a base releasably attached to the tray. In one aspect of this embodiment, the base further includes a storage receptacle. The receptacle is substantially closed when the base and the tray are attached, and the receptacle is open when the base and tray are detached.

In another preferred embodiment of the above dispenser, a first of the plurality of corner members further includes a planar sheet mounting surface extending therefrom. In one aspect of this embodiment, the planar sheet mounting surface is releasably attached to the first corner member. In another aspect of this embodiment, the dispenser further comprises a socket including a concave surface and the planar sheet mounting surface, the first corner member includes a convex surface, and the concave surface of the socket is releasably attached to the convex surface.

In another preferred embodiment of the above dispenser, a first of the plurality of corner members further includes a sheet mounting wire extending therefrom. In one aspect of this embodiment, the sheet mounting wire is releasably attached to the first corner member. In one aspect of this embodiment, the dispenser further comprises a socket including a concave surface and the sheet mounting wire, the first corner member includes a convex surface, and the concave surface of the socket is releasably attached to the convex surface.

In another preferred embodiment of the above dispenser, a first of the plurality of corner members further comprises a receptacle for receiving a writing implement. In one aspect of this invention, the receptacle is releasably attached to the first corner member. In another aspect of this embodiment, the dispenser further comprises a socket including a concave surface and the receptacle for receiving a writing implement, the first corner member further comprises a convex surface, and the concave surface of the socket is releasably attached to the convex surface.

In another preferred embodiment of the above dispenser, the dispenser is in combination with a writing implement. The writing implement includes a socket including a concave surface, a first of the plurality of corner members further includes a convex surface, and the concave surface of the socket is releasably attached to the convex surface.

Another aspect of the present invention provides a dispenser for a stack of sheets comprising a tray including a support surface and a plurality of corner members attached to the tray. Each of the corner members include a first wall and a second wall in which the second wall is non-parallel to the first wall, the first and second walls extend above the support surface, and the plurality of corner members each include a convex surface extending between each respective first and second walls opposite the support surface.

In one preferred embodiment of the just mentioned dispenser, the dispenser further comprises four of the corner members, and the first and second walls of the corner members are generally perpendicular to each other and extend from the support surface. In one aspect of this embodiment, the dispenser comprises a first bridging arm and a second bridging arm. The first arm is releasably attached to the first and second corner members, the second arm is releasably attached to the third and fourth corner members, a sheet dispensing opening is between the first and second arms, and the sheet dispensing opening is centered relative to the tray support surface.

Another aspect of the present invention provides a dispenser for a stack of sheets comprising a tray including a support surface and a back surface opposite the support surface. The back surface includes first and second arm receiving members. A plurality of corner members attached to the tray, in which each of the corner members includes a first wall and a second wall extending above the support surface, and the second wall is non-parallel to the first wall. The dispenser also includes support arm, including a first end and a second end opposite the first end. The first end of the support arm can be releasably attached to either of the first and second receiving members.

In one preferred embodiment of the just described dispenser, the first arm receiving member is at the general center of the back surface and the second arm receiving member is remote from the center of the back surface.

In another preferred embodiment of the above dispenser, the respective first and second walls of each of the corner members extend from the tray support surface, the first and second walls are generally perpendicular to each other, and each of the corner member includes a convex surface extending between each respective first and second walls opposite the support surface.

In another preferred embodiment of the above dispenser, the dispenser further comprises four of the corner members. The respective first and second walls of each of the corner members are generally perpendicular to each other and extend from the support surface.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention provides a dispenser for a stack of sheets. The invention includes several preferred embodiments of the dispenser. Certain embodiments of the dispenser comprise a variety of components. These components make up a modular system of interchangeable components, which can form a variety of alternative embodiments of the dispenser.

Figure 1:
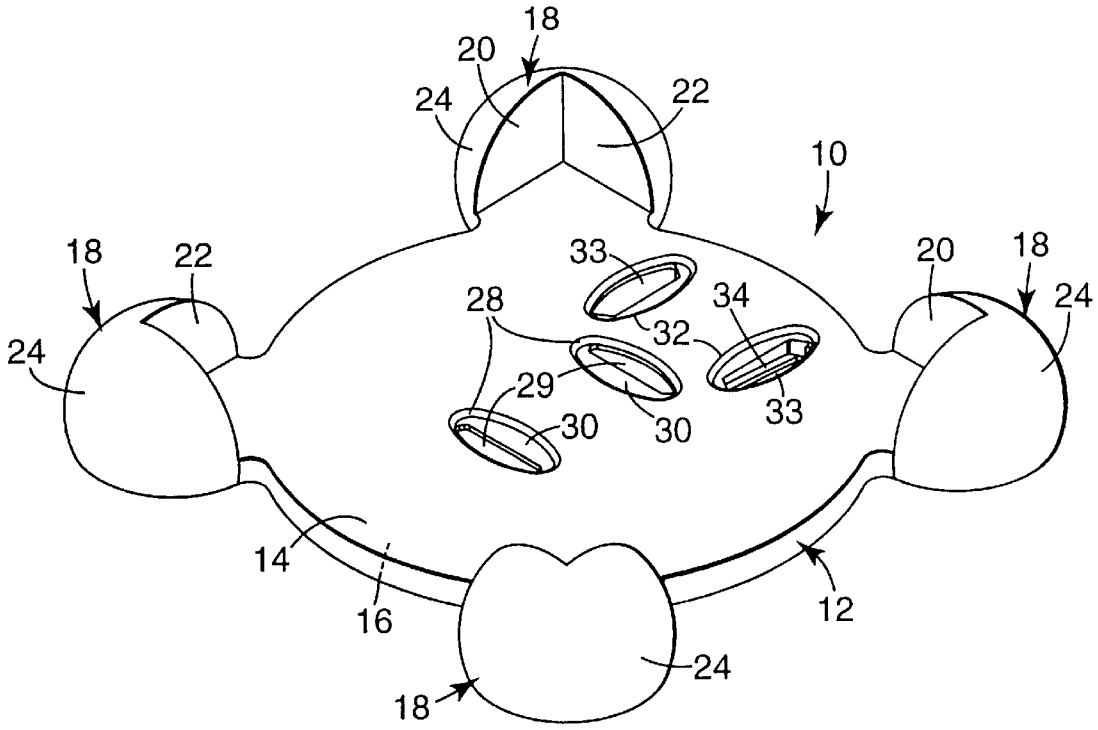
FIG. 1 is an isometric view of a preferred embodiment of a dispenser for a stack of sheets.

FIG. 1 illustrates a first embodiment of dispenser 10 for a stack 35 of sheets. The dispenser 10 includes a tray 12 and a plurality of corner members 18 attached to tray 12. Tray 12 includes a support surface 14 for supporting a stack 35 of sheets and a back surface 16 opposite the support surface 14.

Corner members 18 each include a first wall 20 and a second wall 22 extending above the support surface 14. First and second walls 20, 22 are non-parallel to each other. Preferably, first and second walls 20, 22 extend from support surface 14. However, first and second walls 20, 22 may instead extend from back surface 16 of tray 10, for example. It is also preferred, but not required, that the first and second walls 20, 22 are adjoining. When tray 12 is for holding square or rectangular sheets, it is preferred that first and second walls 20, 22 are perpendicular to each other and also perpendicular to the support surface 14. Preferably, corner members 18 include a convex surface 24 extending between first and second walls 20, 22 opposite support surface 14 for later releasable engagement with other components.

Figure 2:
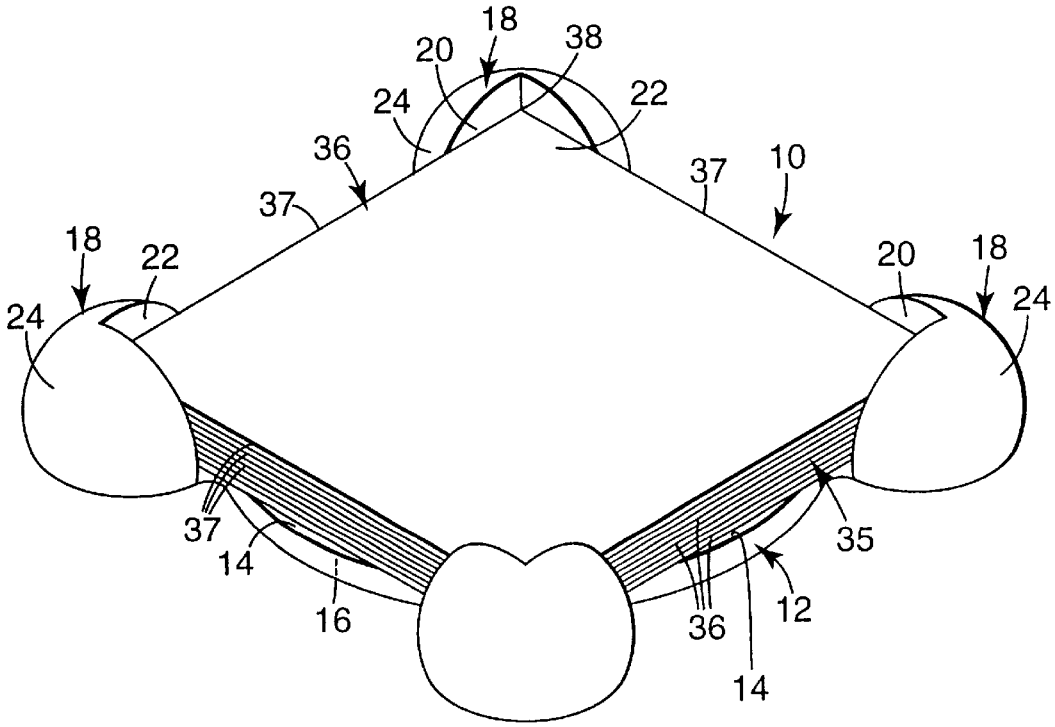
FIG. 2 is an isometric view the dispenser of FIG. 1 with a stack of sheets supported by the dispenser.

FIG. 2 illustrates the dispenser of FIG. 1 including a stack 35 of sheets 36. The sheets 36 include corners 38 and edges 37 extending between adjacent corners 38. Tray support surface 14 of tray 12 supports the stack 35 of sheets 36. Corner members 18 protect the corners 38 of the stack 35 of sheets 36 from inadvertent contact. Such contact may bend or otherwise damage the corners 38 of the sheets 36. First and second walls 20, 22 are preferably configured to closely border corners 38 of sheets 36 and the portion of the edges 37 of sheets 36 adjacent corners 38. The edges 37 of sheets 36 not protected by corner members 18 afford access to the sheets 36 so that individual sheets 36 may be easily removed from dispenser 10. The angle formed between first wall 20 and second wall 22 is preferably similar to or greater than the angle formed between adjacent edges 37 at corners 38 of sheets 36. However, walls 20, 22 may also be curved or otherwise configured to hold sheets of various shapes.

In a preferred embodiment of the present invention, support surface 14 is exposed between two adjacent of the plurality of corner members 18. More preferably, support surface 14 is exposed between each of the plurality of corner members 18. When referring to the support surface 14 as being "exposed" between two adjacent of the plurality of corner members 18, this means at least of portion of support surface 14 does not have any structure extending from it or above it. Keeping the support surface 14 exposed between adjacent corner members 18 allows convenient access to edges 37 of sheets 36, from the top sheet of the stack 35 to the bottom sheet of the stack 35 supported by support surface 14, so that sheets 36 may be easily removed from dispenser.

The stack 35 of sheets 36 may be simply placed on surface 14 of tray 12. Alternatively, the stack 35 of sheets 36 may be attached to tray support surface 14 by mechanical fasteners or double sided tape. Suitable examples of double sided tape include Scotch™ Double Coated Tape 665 available from Minnesota Mining and Manufacturing, St. Paul, Minn. Also, walls 20, 22 may be lined with a compressible material, such as felt, to nestle stack 35 in the dispenser 10. Alternatively, adhesive on the back of the last sheet 36 may be used to attach the stack 35 of sheets 36 to support surface 14. After all of the sheets 36 in the stack 35 are removed from dispenser 10, they may be replaced with a new stack 35 of sheets 36 and the dispenser 10 reused.

FIGS. 1 and 2 illustrate a dispenser 10 including a square tray support surface 14 and four corner members 18, which are sized to support a three inch×three inch (7.62 cm by 7.62 cm) stack 35 of square sheets 36. However, the dispenser 10 may be sized to support and dispense a variety of sheets 36 of different dimensions and different shapes. For example, the dispenser 10 may be sized and configured to hold three inch by five inch (7.62 cm by 12.70 cm) rectangular sheets, triangular-shaped sheets, pentagon-shaped sheets, octagon-shaped sheets, irregular-shaped sheets or non-symmetrical-shaped sheets. The number of corners members 18 and the angle formed by walls 20, 22 are selected to accommodate the desired shape of the sheets 36. An example of sheets 36 is repositionable sheets commercially available from Minnesota Mining and Manufacturing, St. Paul, Minn. under the trade designation "Post-it." Preferably, walls 20, 22 are of a height at least equal to the height of the stack 35 of sheets 36.

Figure 3:
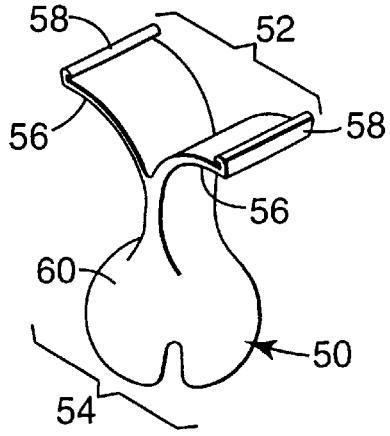
FIG. 3 is an isometric view of a preferred embodiment of a tray support arm.

FIG. 3 illustrates a preferred embodiment of a tray support arm 50, which is one component that maybe combined with tray 12 to form an alternative embodiment of the dispenser 10 illustrated in FIGS. 4–7. Support arm 50 has a first end 52 and a second end 54 opposite first end 52. First end 52 of support arm 50 preferably includes two webs 56 with hook-like distal ends 58 for releasable attachment to the back surface 16 of tray 12. Second end 54 may optionally be configured for permanent or releasable attachment to another object or surface. For example, second end of 54 of support arm 50 may be one element of a ball and socket joint. Preferably, second end 54 of support arm 50 includes the socket 60 to allow attachment to pedestal 70, as explained below. A preferred embodiment of arm 50 is disclosed in U.S. Pat. No. 5,358,141.

Figure 4:
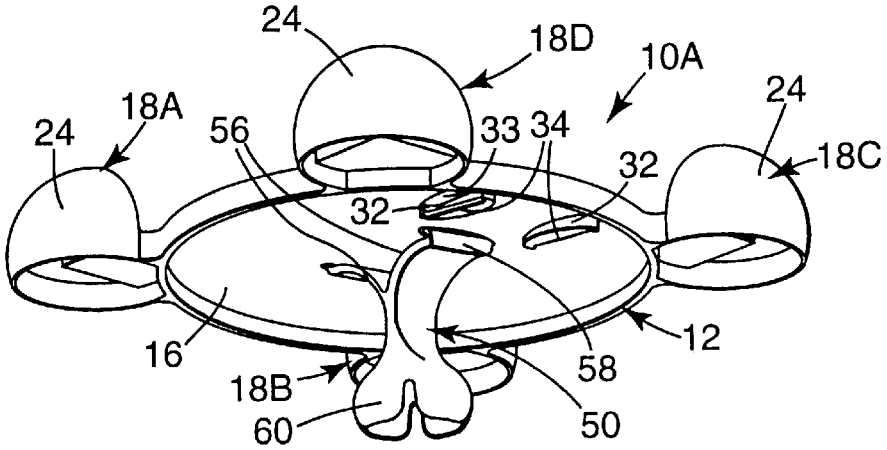
FIG. 4 is an isometric view of the tray support arm of FIG. 3 attached to the center of the back surface of the tray of FIG. 1.

As seen in FIG. 4, the hook-like ends 58 of the first end 52 of support arm 50 are releasably attached to a first arm receiving member 28 at the back surface 16 of tray 12. As seen in FIG. 1, first arm receiving member 28 is preferably centered on the back surface 16 of tray 12. Second arm receiving member 32 is preferably located remote from the center of the back surface 16. However, arm receiving members 28, 32 may be located anywhere along the back surface 16 of tray 12. Additionally, dispenser 10 may include more than two arm receiving members or only one arm receiving member. First arm receiving member 28 includes two transversely extending openings 29 partially defined by lips 30. Second arm receiving member 32 includes two transversely extending openings 33 partially defined by lips 34. The opposed hook-like distal ends 58 of support arm 50 are adapted to releasably engage with openings 29, 33 and lips 30, 34 of first and second arm receiving members 28, 32.

Figure 5:
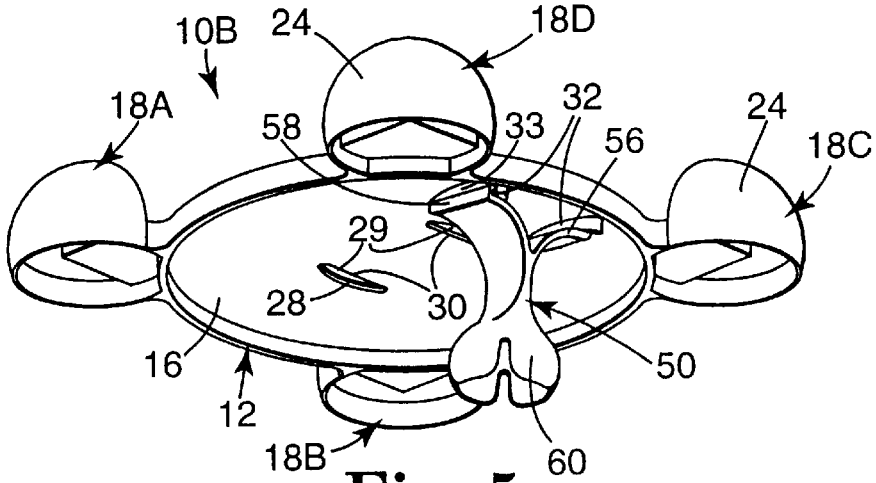
FIG. 5 is a view of FIG. 4 with the tray support arm attached to the back surface of the tray at a location remote from the center of the back surface.

FIGS. 4 and 5 illustrate how the component of the support arm 50 may be used to create two alternative embodiments of dispenser 10 labeled 10A and 10B. In FIG. 4, the first end 52 of support arm 50 is attached to first arm receiving member 28 at the center of tray 12. In FIG. 5, support arm 50 is attached to second arm receiving member 32 of tray 12 at a location remote from the center of tray 12. Support arm 50 may releasably attach to either first arm receiving member 28 or second arm receiving member 32. Support arm 50 is releasably attached to arm receiving members 28, 32 by extending hook-like distal ends 58 through openings 29, 33 and allowing attachment of hook like distal ends 58 with lips 30, 34. Support arm 50 is releasably detached from arm receiving members 28, 32 by disengaging hook-like distal ends 58 from lips 30, 34 and pulling hook like distal ends 58 from openings 29, 30.

Figure 6:
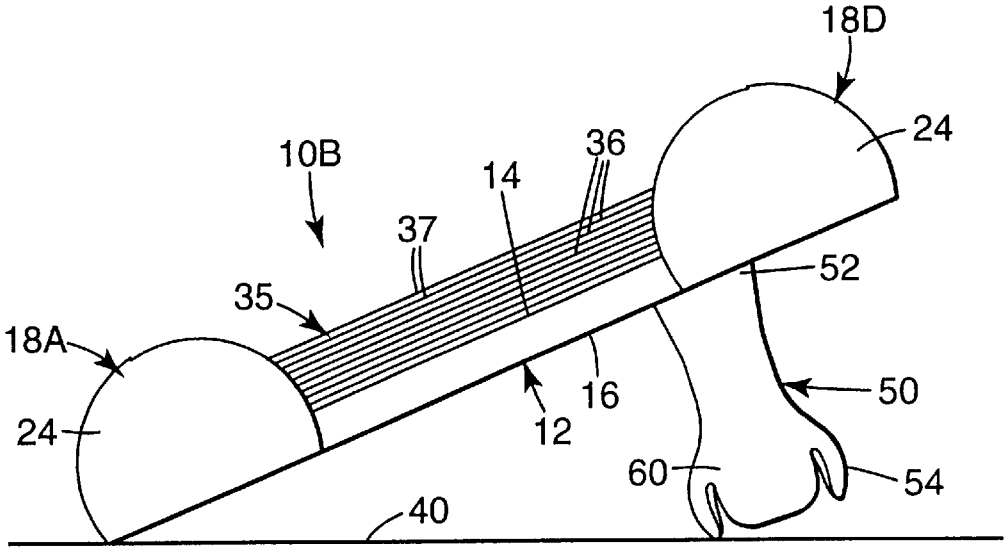
FIG. 6 is a side view of the dispenser of FIG. 5 in a first easel position with a stack of sheets supported by the dispenser.
Figure 7:
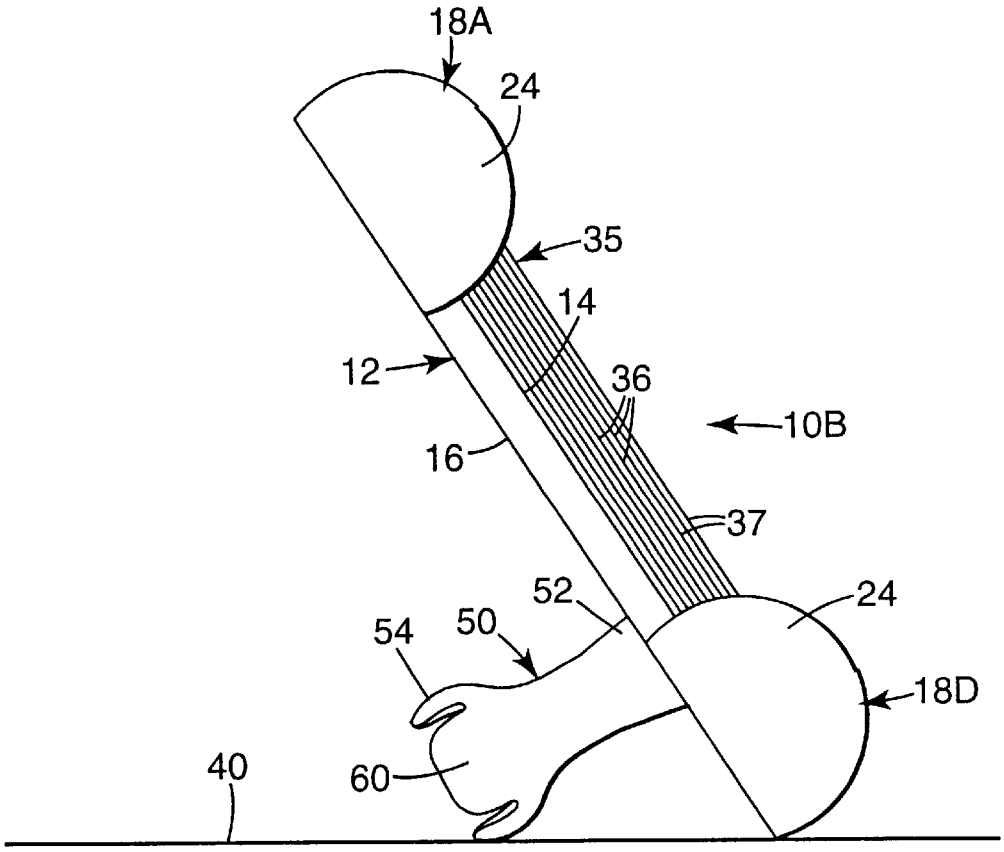
FIG. 7 is a side view of the dispenser of FIG. 5 in a second easel position with a stack of sheets supported by the dispenser.

When support arm 50 is attached to second arm receiving member 32 of tray 12, as illustrated in FIG. 5, the dispenser 10B is capable of at least two easel positions, where the dispenser 10 is inclined relative to the surface on which it rests. FIG. 6 illustrates dispenser 10B in a first easel position. In the first easel position, the second end 54 of support arm 50 and the first and second corner members 18A, 18B, located opposite the second arm receiving member 32 contact surface 40. This provides a shallow angle for support surface 14 of tray 12 relative to the surface 40. FIG. 7 illustrates dispenser 10B in a second easel position. In the second easel position, support arm 50 and the third and fourth corner members 18C, 18D, located adjacent the second arm receiving member 32, contact surface 40. This provides a steeper angle of the support surface 14 of tray 12 relative to the surface 40. Such an orientation makes the dispenser 10 more prominent and visible. Additionally, the second arm receiving member 32 of tray 12 may be located at a variety of positions on tray 12 to provide different easel angles.

When support arm 50 is attached to first arm receiving member 28 at the center of tray 12, as illustrated in FIG. 4, any pair of adjacent corner members 18 of the dispenser 10 may rest on the surface 40, thus providing similar easel angles.

In all easel positions, walls 20, 22 of corner members 18 protect the corners 38 of sheets 36, even as dispenser 10 is manipulated from one easel position to the next easel position. Additionally, the corner members 18 can support the stack 35 of sheets 36 at any easel position, even if the stack 35 is not adhered or otherwise attached to surface 14.

Figure 8:
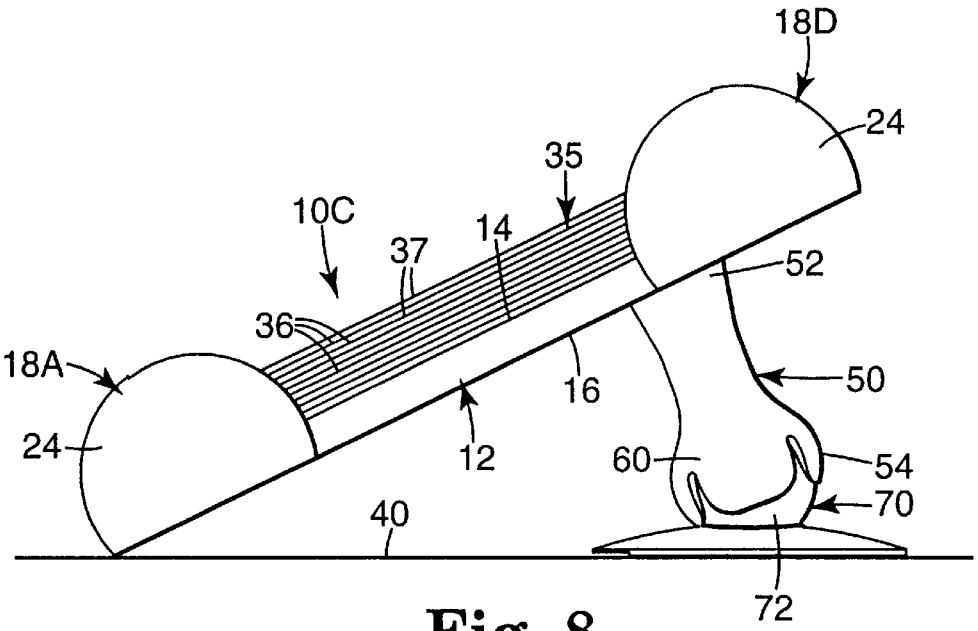
FIG. 8 is side view of the dispenser of FIG. 5 attached to a pedestal mounted on a surface.

FIG. 8 illustrates the dispenser in combination with another component, the pedestal 70, to form an alternative embodiment of dispenser 10 labeled 10C. Pedestal 70 releasably attaches dispenser 10 to a surface 40. Pedestal 70 is configured to releasably attach to the second end 54 of arm 50. Preferably, when second end 54 of the arm comprises a socket, pedestal 70 includes a ball 72. Socket 60 located at the second end 54 of support arm 50 is releasably attached to the ball 72 of pedestal 70, forming elements of a ball and socket joint. Alternatively, the elements of the ball and socket joint may be reversed, for example, the second end 54 of support arm 50 could include a ball for releasably attaching to a socket on pedestal 70. Pedestal 70 may attach or releasably attach to surface 40 in a variety of ways known to those skilled in the art, for example, by adhesive. Alternatively, second end 54 of support arm may releasably attach or permanently attach to surface 40 by a variety of means know to those skilled in the art, for example, by adhesive. A preferred example of pedestal 70 is described in U.S. Pat. No. 5,358,141.

Figure 9:
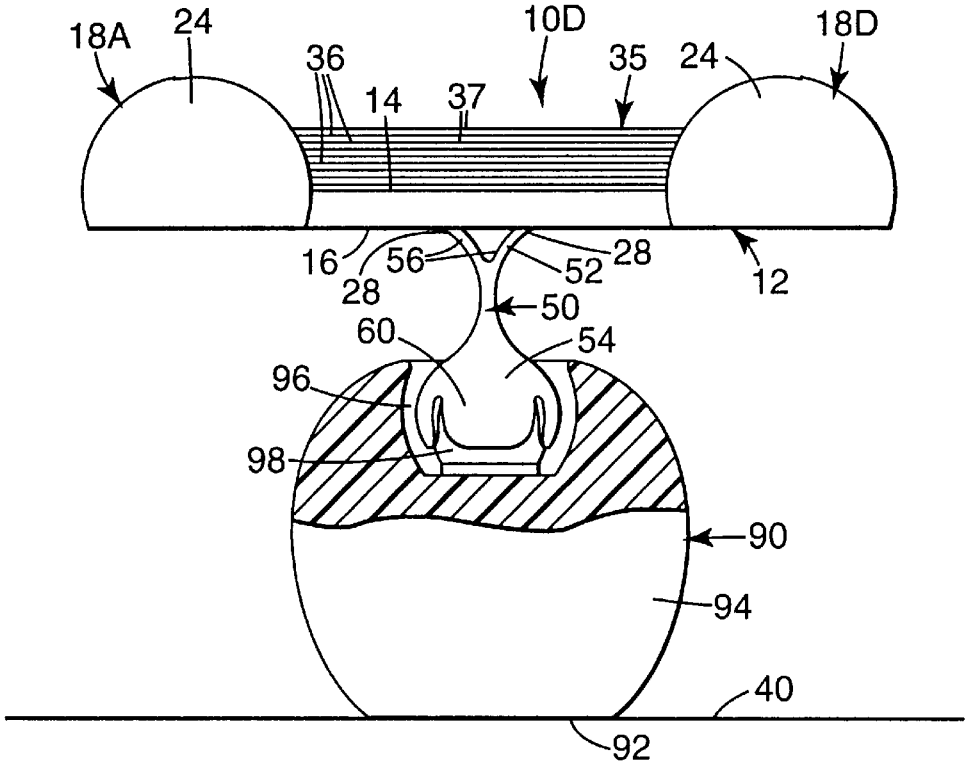
FIG. 9 is a partial cross section of an alternative embodiment of the dispenser including the tray support arm of FIG. 3 and a preferred embodiment of a base with a stack of sheets supported by the dispenser.

As illustrated in FIG. 9, base 90 is used in combination with tray 12 and support arm 50 (described above with respect to FIGS. 4–7) to form an alternative embodiment of the dispenser 10 labeled 10D. Dispenser 10D raises stack 35 of sheets 36 higher from a surface 40 and allows a user to tilt tray 12 in a variety of angles. Base 90 includes a back surface 92 and an outer surface 94. Back surface 92 is preferably planar. However, back surface 92 may be also be convex or concave. Preferably, tray 12 has a first density and base 90 has a second density, which is higher than the first density. For instance, base 90 may be filled with steel shot to provide a steady base. Base 90 is configured for releasable attachment to the second end 54 of arm 50. When arm 50 includes socket 60 at second end 54, base 90 includes ball 98 for releasably attaching to the socket 60. In one embodiment, ball 98 is mounted in a recess 96 at the top of base 90. A preferred embodiment of base 90 is disclosed in U.S. Pat. No. 5,794,815.

FIG. 9 illustrates the first end 52 of support arm 50 releasably attached to the first arm receiving members 28 at the center of tray 12. However, as mentioned above, first end 52 of support arm 50 may be attached to the second arm receiving members 32 of tray 12, thus displaying support surface 14 at alternative positions. As tray 12 and support arm 50 are rotated about base 90, walls 20, 22 of corner members 18 support stack of sheets 36 to the desired orientation, protect the corners 38 of sheets 36. Access to edges 37 of sheets 36 is provided between adjacent corner members 18.

Figure 10:
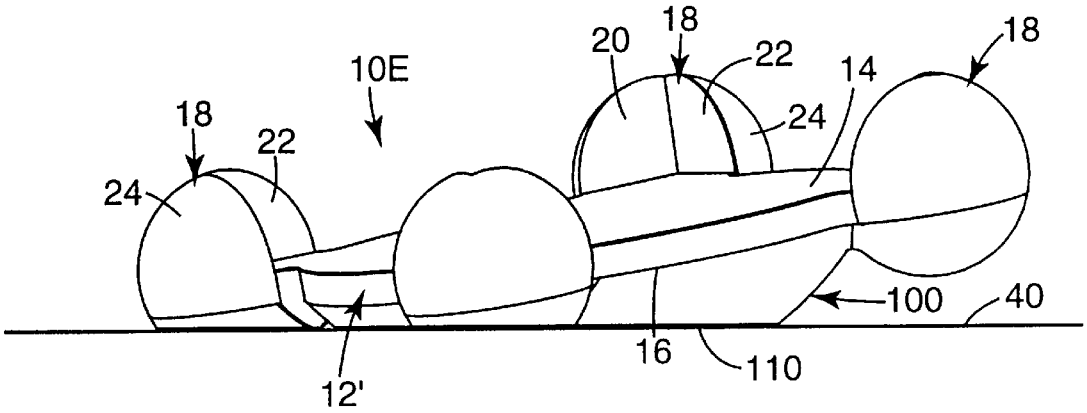
FIG. 10 is an isometric view of an alternative embodiment of the dispenser including a planar back surface.

FIG. 10 illustrates tray 12' and alternative base 100 combined to form an alternative embodiment of the dispenser 10 labeled 10E. Base 100 includes a planar back surface 110 opposite tray support surface 14. Planar back surface 110 may be parallel or non-parallel to tray support surface 14 to display the stack 35 of sheets 36 at parallel or any desired angle. The tray 12 is attached to base 100 such that the support surface 14 is exposed. If tray 12 is permanently attached to base 100, the tray 12' does not require the arm receiving members 28, 32, as illustrated. Tray 12' and base 100, maybe permanently attached such as by sonic welding the two pieces together, as is commonly known in the art. Instead, tray 12' may be releasably attached to base 100, such as by a friction fit or a snap fit, for example. In such an embodiment, tray 12' may include arm receiving members described above. This releasable feature allows tray 12' to combine with arm 50 discussed above, or with additional components, as illustrated in FIGS. 11–15. Tray 12' may have a first density and base 100 may have a second density, which is higher than the first density, such that base 100 is weighted down. For instance, base 100 may contain steel shot or any other suitable dense material.

Figure 11:
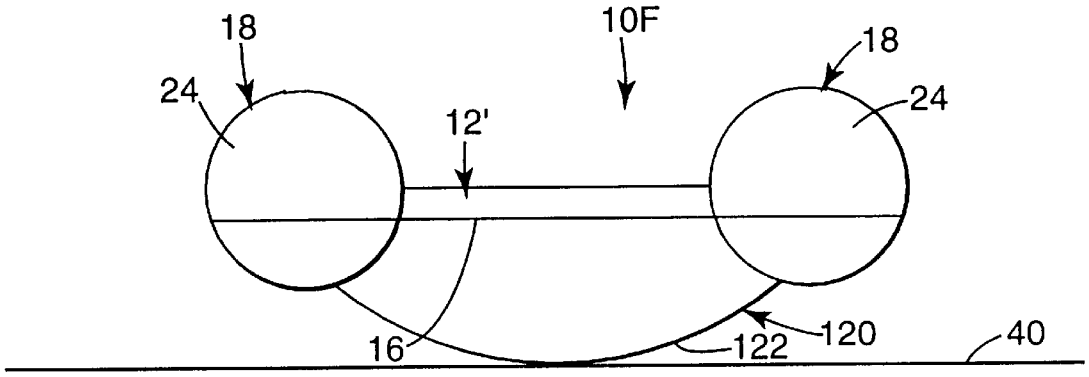
FIG. 11 is a side view of an alternative embodiment of the dispenser including a convex back surface.

FIG. 11 illustrates the tray 12' combined with base 120 to form an alternative dispenser 10 labeled 10F. Base 120 includes a convex back surface 122 opposite tray support surface 14. If tray 12' is permanently attached to base 120, then tray 12' does not require the arm receiving members 28, 32, as illustrated. Tray 12' and base 100 may be permanently attached, such as by sonic welding the two pieces together, as is commonly known in the art. Instead, tray 12' may be releasably attached to base 120, such as by a friction fit or snap fit, for example. In such an embodiment, tray 12' may include arm receiving members 28, 32 described above. This releasable feature allows tray 10 to combine with arm 50 discussed above, or with additional components, as illustrated in FIGS. 12–15. Additionally, tray 12' may have a first density and base 120 may have a second density, which is higher than the first density, such that base 120 is weighted down. For instance, base 120 may contain steel shot or any other suitable dense material.

Figure 12:
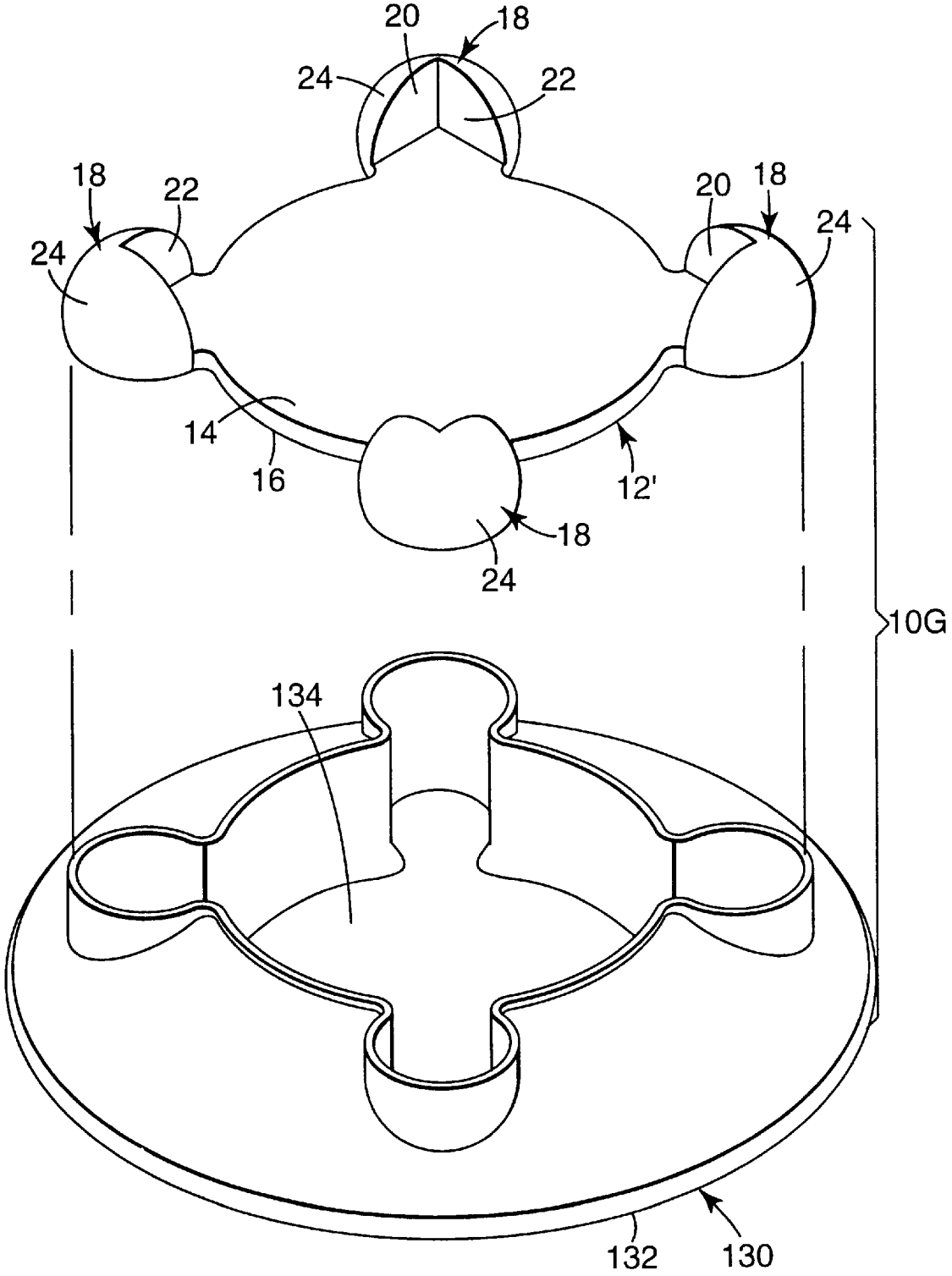
FIG. 12 is an exploded view of an alternative embodiment of the dispenser including a base having a storage receptacle.

FIG. 12 illustrates tray 12' of FIGS. 10–11 combined with base 130, which includes a storage receptacle 134, to form an alternative dispenser 10 labeled 10G. Base 130 includes a circular, planar back surface 132. The back surface 16 of tray 12' is sized to cover storage receptacle 134. However, tray 12' may instead be sized to fit inside storage receptacle 134. When base 130 is releasably attached to tray 12', the storage receptacle 134 is substantially closed. The receptacle 134 is substantially open when the base 130 and tray 12' are detached. Storage receptacle 134 may be used to store items such as additional stacks 35 of sheets 36, paper clips, or other such office items. Base 130 may be weighted down with steel shot for example, similar to bases 100, 120 described above.

Figure 13:
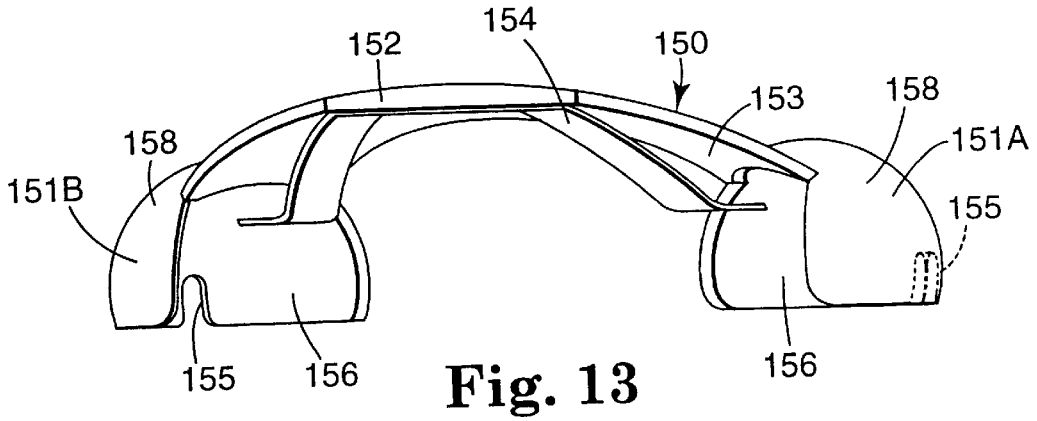
FIG. 13 is a side view of a bridging arm including a sheet retaining member.

FIG. 13 illustrates yet another component for use with the modular dispenser system. The bridging arm 150 illustrated in FIG. 13 is configured to permanently attach or releasably attach with corner members 18 of any dispenser described herein. Arm 150 includes first arm corner member 151A and second arm corner member 151B, and a center arm portion 152 extending between the two arm corner members 151A, 151B. Arm corner members 151 each include a concave surface 156 and a convex surface 158 opposite the concave surface 156. Arm corner members 151 may include notch 155 located opposite the center arm portion 150. Center arm portion 150 includes an inner surface 153. Preferably, a sheet retaining member 154 is mounted on the inner surface 153 of center arm portion 150. The sheet retaining member 154 is moveable from a first position to a second position, and is biased towards the first position.

Figure 14:
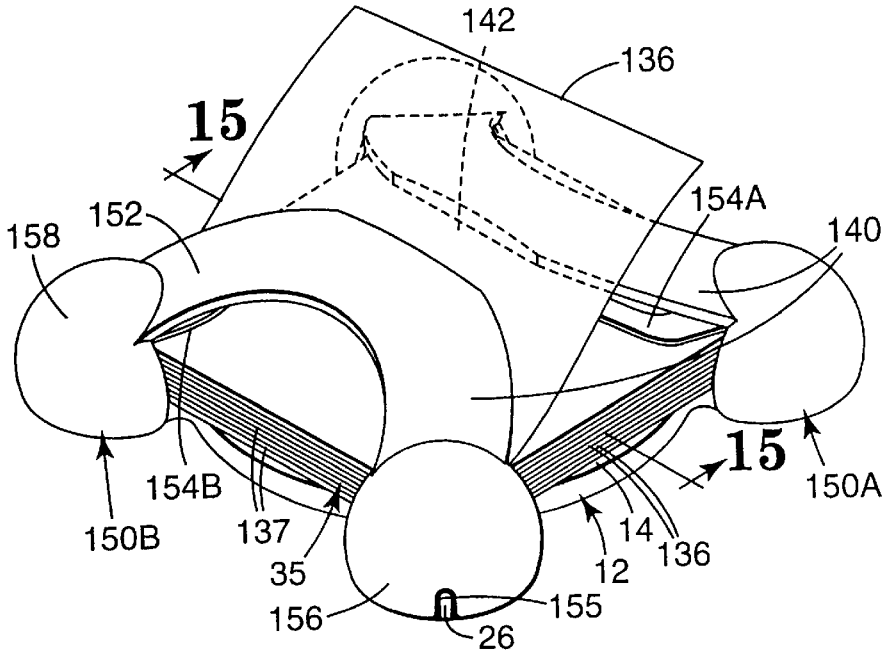
FIG. 14 is an isometric view of an alternative embodiment of the dispenser including a center feed cover comprising two of the arms of FIG. 13, with a stack of sheets supported by the dispenser.

FIG. 14 illustrates first and second arms 150A and 150B combined with tray 12 or tray 12' to form an alternative dispenser 10 labeled 10H. Concave surfaces 156 of arm corner members 151 releasably attach to the convex surfaces 24 of corner members 18. Concave surfaces 156 of first arm 150A are shown releasably attached to first and second corner members 18A, 18B. Concave surfaces 156 of second arm 150B are shown releasably attached to third and fourth corner members 18C, 18D. The first and second bridging arms 150A, 150B together comprise a center feed cover 140. The center feed cover 140 includes a sheet dispensing opening 142 formed between the center arm portions 152 of arms 150A, 150B. Preferably, sheet dispensing opening 142 is centered relative to the tray support surface 14.

Figure 15:
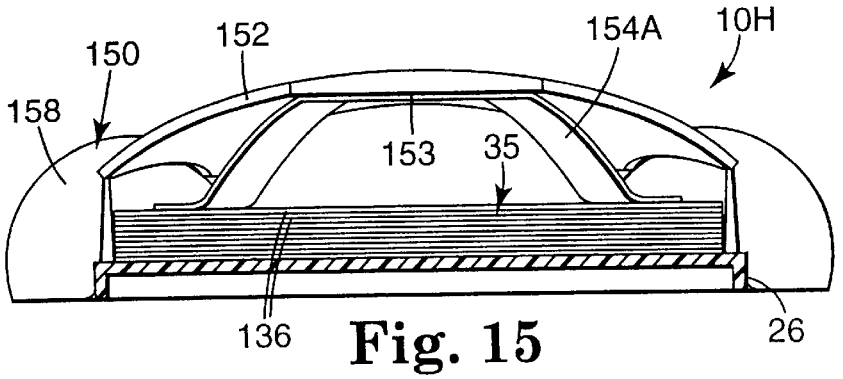
FIG. 15 is a cross-sectional view of the dispenser of FIG. 14 taken along line 15—15.

Preferably, the dispenser 10H of FIGS. 14–15 is for use with stack 35 of sheets 136. Sheets 136 have a narrow band of adhesive, such as repositionable pressure sensitive adhesive, coated on one surface along one edge 137. Sheets 136 are then stacked with the band of adhesive of adjacent sheets at alternating opposite edges of the stack 35. An example of sheets 136 is described in U.S. Pat. No. 4,416,392. As sheets 136 are lifted from opposite edges 137 of the stack 35, this creates an upward force against the center feed cover 140, which could lead to disengagement of the center feed cover 140 from corner members 18. To help present this disengagement of excessive rotation of the arms, corner members 18 preferably include protrusions 26 which engage with notches 155 of arm corner members 151. Engagement of protrusions 26 and notches 155 helps prevent disengagement or rotation of arm corner members 151 from corner members 18 as sheets 136 are pulled through the sheet dispensing opening 142. Alternatively, a rim or ledge (not illustrated) on the bottom of convex surface 24 of each corner member 18 may engage with the bottom edge of the arm corner member 151 to help prevent rotation or disengagement of the arms. The force of the snap fit between corner member 18 and arm corner members 151 of arms 150 is selected to be sufficient to withstand the force caused by removing individual sheets 136 from the stack 35.

FIG. 15 illustrates a cross sectional view of the dispenser 10H of FIG. 14 taken along line 15—15. Concave surface 156 of arm corner member 151 is releasably engaged with the convex surface 24 of corner arm 18. A first sheet retaining member 154A is mounted on the inner surface 153 of first arm 150A. Although not pictured, a second sheet retaining member 154B is mounted on the inner surface 153 of second arm 150B. The sheet retaining members are elastically flexible, and are sized and shaped to retain sheets 136 flush against tray support surface 14 and assists in the separation between adjacent sheets 136. Preferably, sheet retaining members 154A, 154B are movable from a first position proximate the tray support surface 14 to a second position remote from the tray support surface 14. The retaining members have sufficient force and flexibility to allow each sheet 136 in stack 35 to be individually pulled from the dispenser. In one suitable arrangement, the sheet retaining members 154 are made of 0.008 inch thick spring steel. The retaining members may be attached to the bridging arms by any suitable means. For example, the sheet retaining members 154 may be heat staked or cold staked to the inner surface 153 of arm 150, as is commonly known in the art. Preferably, the sheet retaining members 154 are heat staked to the inner surface 153 of arm 150.

When all sheets 136 are dispensed, a new stack 35 of sheets 136 may be inserted into dispenser 10. This may be done by first detaching the concave surfaces 156 of first and second arms 154A, 154B from convex surfaces 24 of corner members 18, then placing a replacement stack 35 of sheets 136 on support surface 14 of tray 12, and finally re-attaching the concave surfaces 156 of first and second arms 154A, 154B to the convex surfaces 24 of corner members 18.

Figure 16:
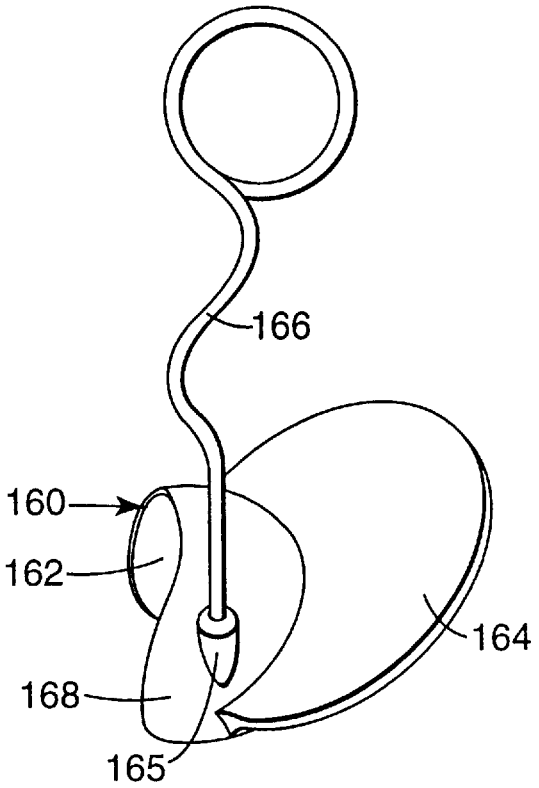
FIG. 16 is an isometric view of a preferred embodiment of a socket including a planar surface mounting surface and a sheet mounting wire.

FIG. 16 illustrates another component, a socket 160, for use with the modular system of dispensers 10. Socket 160 may be part of the convex surface 24 of any corner member 18 or a part of the convex surface 158 of any arm corner member 151 described above. As illustrated, socket 160 is a discrete or stand alone socket 160 for releasable attachment to any corner member 18 or any arm corner member 151. Socket 160 is configured or sized for release attachment to a corner member 18 or to an arm corner member 151 as desired. Socket 160 includes a concave surface 162 and a convex surface 168 opposite the concave surface 162. The concave surface 162 is for releasable attachment to a convex surface 24 of corner member 18 or to a convex surface 156 of arm 150.

The socket 160 is illustrated as including a planar sheet mounting surface 164 and a sheet mounting wire 166. The socket portion 160 may include either or both of these elements. The planar sheet mounting surface 164 extends from the socket portion and is used as a place to mount sheets 36, 136. The sheet mounting wire 166 extends from the wire receptacle 165 and is used to hang sheets 36, 136.

Figure 17:
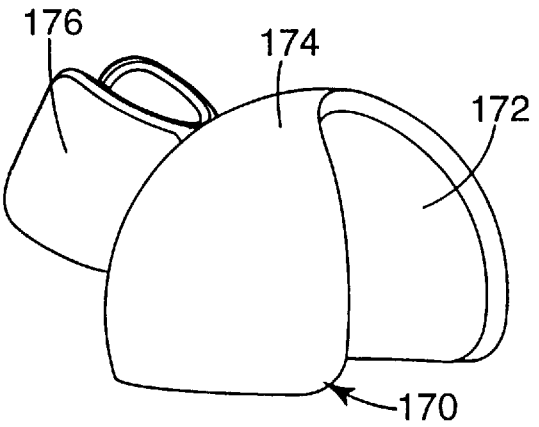
FIG. 17 is an isometric view of a preferred embodiment of a socket including a receptacle for receiving a writing implement.

FIG. 17 illustrates another component, a socket 170 for use with the modular system of dispensers 10. Socket 170 may be a part of the convex surface 24 of any corner member 18 or the convex surface 158 of any arm corner member 151 described above. As illustrated, socket 170 is a discrete or stand alone socket 170 for releasable attachment to any corner member 18 or any arm corner member 151. Socket 170 includes a concave surface 172 and a convex surface 174 opposite the concave surface 172. The concave surface 172 is for releasable attachment to a convex surface 24 of corner member 18 or to a convex surface 156 of arm 150. Socket 170 includes a receptacle 176 mounted on the convex surface 174. The receptacle 176 releasably engages with a writing implement such as a pen or pencil for convenient storage. Alternatively, the writing implement may be permanently attached to socket 170 such that socket 170 and the writing implement may be releasably attached to an arm corner member 151 or to a corner member 18. Socket 170 may also include either or both of the mounting surface 164 and mounting wire 166 described above.

The preferred method of manufacture for all of the components mentioned above is thermoplastic injection molding, as is commonly known in the art. All of the components mentioned above preferably comprise polystyrene-based resins.

The present invention has now been described with reference to several embodiments thereof. The foregoing detailed description has been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A dispenser for a stack of sheets, comprising:

a) a tray including a support surface; and b) a plurality of corner members attached to said tray, wherein each of said corner members include a first wall and a second wall extending above said support surface, wherein said second wall is non-parallel to said first wall, wherein said first wall and said second wall are adjoining, and wherein said support surface is exposed between two adjacent of said plurality of corner members.

2. The dispenser of claim 1, wherein said support surface is exposed between each adjacent corner members.

3. A dispenser for a stack of sheets, comprising:

a) a tray including a support surface;

b) a plurality of corner members attached to said tray, wherein each of said corner members include a first wall and a second wall extending above said support surface, wherein said second wall is non-parallel to said first wall, and wherein said support surface is exposed between two adjacent of said plurality of corner members; and c) a center feed cover releasably attached to said plurality of corner members, wherein said center feed cover includes a sheet dispensing opening.

4. The dispenser of claim 3, wherein said sheet dispensing opening is centered relative to said tray support surface.

5. The dispenser of claim 3, wherein said center feed cover comprises a first bridging arm and a second bridging arm, wherein said first arm is releasably attached to a first and a second of said plurality of said corner members, wherein said second arm is releasably attached to a third and a fourth of said plurality of corner members, and wherein said sheet dispensing opening is between said first and second arms.

6. The dispenser of claim 5, wherein said first arm further comprises a planar sheet mounting surface extending therefrom.

7. The dispenser of claim 6, further comprising a socket including a concave surface, wherein said socket includes said sheet mounting surface, wherein said first arm further includes a convex surface, and wherein said concave surface of said socket is releasably attached to said convex surface of said first arm.

8. The dispenser of claim 5, wherein said first arm further comprises a sheet mounting wire extending therefrom.

9. The dispenser of claim 8, further comprising a socket including a concave surface, wherein said socket includes said sheet mounting wire, wherein said first arm further includes a convex surface, and wherein said concave surface of said socket is releasably attached to said convex surface of said first arm.

10. The dispenser of claim 5, wherein said first arm further comprises a receptacle for receiving a writing implement.

11. The dispenser of claim 10, further comprising a socket including a concave surface, wherein said socket includes said receptacle, wherein said first arm further includes a convex surface, and wherein said concave surface of said socket is releasably attached to said convex surface of said first arm.

12. The dispenser of claim 5, wherein said first, second, third and fourth corner members include a respective convex surface, wherein said first arm comprises a first concave surface and a second concave surface, wherein said first concave surface of said first arm is releasably attached to said convex surface of said first corner member, wherein said second concave surface of said first arm is releasably attached to said convex surface of said second corner member, wherein said second arm comprises a third concave surface and a fourth concave surface, wherein said third concave surface of said second arm is releasably attached to said convex surface of said third corner member, and wherein said fourth concave surface of said second arm is releasably attached to said convex surface of said fourth corner member.

13. The dispenser of claim 5, wherein said first arm further includes a first sheet retaining member moveable from a first position proximate said tray support surface to a second position remote from said support surface, and wherein said retaining member is biased towards said first position.

14. The dispenser of claim 13, wherein said second arm includes a second retaining member moveable from a first position proximate said tray support surface to a second position remote from said support surface, and wherein said retaining member is biased toward said first position.

15. A dispenser for a stack of sheets, comprising:

a) a tray including a support surface; and b) a plurality of corner members attached to said tray, wherein each of said corner members include a first wall and a second wall extending above said support surface, wherein said second wall is non-parallel to said first wall, wherein said support surface is exposed between two adjacent of said plurality of corner members, wherein each of said first and second walls of said corner members extend from said tray support surface, wherein said first and second walls are generally perpendicular to each other, and wherein each of said corner members includes a convex surface extending between each respective first and second walls opposite said support surface.

16. The dispenser of claim 1, wherein said tray includes a back surface opposite said support surface, and wherein said dispenser further includes a support arm including a first end and a second end opposite said first end, and wherein said first end is attached to said back surface.

17. The dispenser of claim 16, wherein said first end of said support arm is releasably attached to said back surface.

18. The dispenser of claim 17, wherein said back surface includes first and second arm receiving members, wherein said first end of said support arm can be releasably attached to either of said first and second arm receiving members.

19. The dispenser of claim 18, wherein said first receiving member is centered on said back surface and wherein said second arm receiving member is remote from the center of said back surface.

20. The dispenser of claim 16, wherein said second end of said support arm comprises one element of a ball and socket joint.

21. A dispenser for a stack of sheets, comprising:

a) a tray including a support surface, wherein said tray has a first density;

b) a plurality of corner members attached to said tray, wherein each of said corner members include a first wall and a second wall extending above said support surface, wherein said second wall is non-parallel to said first wall, and wherein said support surface is exposed between two adjacent of said plurality of corner members; and c) a base having a second density higher than said first density.

22. The dispenser of claim 1, further comprising a planar back surface opposite said tray support surface.

23. The dispenser of claim 22, wherein said back surface is non-parallel to said tray support surface.

24. A dispenser for a stack of sheets, comprising:

a) a tray including a support surface and a planar back surface opposite said support surface;

b) a plurality of corner members attached to said tray, wherein each of said corner members include a first wall and a second wall extending above said support surface, wherein said second wall is non-parallel to said first wall, and wherein said support surface is exposed between two adjacent of said plurality of corner members; and c) a base releasably attached to said tray, wherein said base comprises said planar back surface.

25. A dispenser for a stack of sheets, comprising:

a) a tray including a support surface and a back surface opposite said support surface, wherein said back surface is convex; and b) a plurality of corner members attached to said tray, wherein each of said corner members include a first wall and a second wall extending above said support surface, wherein said second wall is non-parallel to said first wall, and wherein said support surface is exposed between two adjacent of said plurality of corner members.

26. The dispenser of claim 25, further comprising a base releasably attached to said tray, and wherein said base comprises said convex surface.

27. A dispenser for a stack of sheets, comprising:

a) a tray including a support surface;

b) a plurality of corner members attached to said tray, wherein each of said corner members include a first wall and a second wall extending above said support surface, wherein said second wall is non-parallel to said first wall, and wherein said support surface is exposed between two adjacent of said plurality of corner members; and c) a base releasably attached to said tray.

28. The dispenser of claim 27, wherein said base further includes a storage receptacle, wherein said receptacle is substantially closed when said base and said tray are attached, and wherein said receptacle is open when said base and tray are detached.

29. The dispenser of claim 1, wherein a first of said plurality of corner members further includes a planar sheet mounting surface extending therefrom.

30. The dispenser of claim 29, wherein said planar sheet mounting surface is releasably attached to said first corner member.

31. The dispenser of claim 30, further comprising a socket including a concave surface and said planar sheet mounting surface, wherein said first corner member includes a convex surface, and wherein said concave surface of said socket is releasably attached to said convex surface.

32. A dispenser for a stack of sheets comprising:

a) a tray including a support surface; and b) a plurality of corner members attached to said tray, wherein each of said corner members include a first wall and a second wall extending above said support surface, wherein said second wall is non-parallel to said first wall, wherein said support surface is exposed between two adjacent of said plurality of corner members, and wherein a first of said plurality of corner members further includes a sheet mounting wire extending therefrom.

33. The dispenser of claim 32, wherein said sheet mounting wire is releasably attached to said first corner member.

34. The dispenser of claim 33, further comprising a socket including a concave surface and said sheet mounting wire, wherein said first corner member includes a convex surface, and wherein said concave surface of said socket is releasably attached to said convex surface.

35. The dispenser of claim 1, wherein a first of said plurality of corner members further comprises a receptacle for receiving a writing implement.

36. The dispenser of claim 35, wherein said receptacle is releasably attached to said first corner member.

37. The dispenser of claim 36, further comprising a socket including a concave surface and said receptacle for receiving a writing implement, wherein said first corner member further comprises a convex surface, and wherein said concave surface of said socket is releasably attached to said convex surface.

38. A dispenser for a stack of sheets, comprising:

a) a tray including a support surface;

b) a plurality of corner members attached to said tray, wherein each of said corner members include a first wall and a second wall extending above said support surface, wherein said second wall is non-parallel to said first wall, and wherein said support surface is exposed between two adjacent of said plurality of corner members; and c) a writing implement, wherein said writing implement includes a socket including a concave surface, wherein a first of said plurality of corner members further includes a convex surface, and wherein said concave surface of said socket is releasably attached to said convex surface.

39. A dispenser for a stack of sheets, comprising:

a) a tray including a support surface; and b) a plurality of corner members attached to said tray, wherein each of said corner members include a first wall and a second wall, wherein said second wall is non-parallel to said first wall, wherein said first and second walls extend above said support surface, and wherein said plurality of corner members each include a convex surface extending between each respective first and second walls opposite said support surface.

40. The dispenser of claim 39, further comprising four of said corner members, wherein said first and second walls of said corner members are generally perpendicular to each other and extend from said support surface.

41. The dispenser of claim 40, further comprising a first bridging arm and a second bridging arm, wherein said first arm is releasably attached to said first and second corner members, wherein said second arm is releasably attached to said third and fourth corner members, wherein a sheet dispensing opening is between said first and second arms, and wherein said sheet dispensing opening is centered relative to said tray support surface.

42. A dispenser for a stack of sheets, comprising:

a) a tray including a support surface and a back surface opposite said support surface, wherein said back surface includes first and second arm receiving members; and b) a plurality of corner members attached to said tray, wherein each of said corner members includes a first wall and a second wall extending above said support surface, wherein said second wall is non-parallel to said first wall; and c) a support arm including a first end and a second end opposite said first end, wherein said first end can be releasably attached to either of said first and second receiving members.

43. The dispenser of claim 42, wherein said first arm receiving member is at the general center of said back surface and wherein said second arm receiving member is remote from the center of said back surface.

44. The dispenser of claim 42, wherein said respective first and second walls of each of said corner members extend from said tray support surface, wherein said first and second walls are generally perpendicular to each other, and wherein each of said corner member includes a convex surface extending between each respective first and second walls opposite said support surface.

45. The dispenser of claim 42, further comprising four of said corner members, wherein said respective first and second walls of each of said corner members are generally perpendicular to each other and extend from said support surface.

* * * * *